US008191808B2

(12) United States Patent
Tanaka et al.

(10) Patent No.: US 8,191,808 B2
(45) Date of Patent: Jun. 5, 2012

(54) FLUID SPRAY NOZZLE, PULVERIZER AND METHOD OF PREPARING TONER

(75) Inventors: Tetsuya Tanaka, Shizuoka-ken (JP); Masahiro Kawamoto, Shizuoka-ken (JP); Akio Matsui, Shizuoka-ken (JP); Hiroki Morioka, Shizuoka-ken (JP); Kaoru Aoki, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 327 days.

(21) Appl. No.: 12/567,290

(22) Filed: Sep. 25, 2009

(65) Prior Publication Data

US 2010/0072311 A1 Mar. 25, 2010

(30) Foreign Application Priority Data

Sep. 25, 2008 (JP) ..... 2008-245558
Oct. 27, 2008 (JP) ..... 2008-275934

(51) Int. Cl.
*B02C 19/06* (2006.01)

(52) U.S. Cl. ..... 241/39; 239/601; 406/92; 406/194

(58) Field of Classification Search ..... 241/5, 39, 241/40, 79.1; 239/601; 406/92, 194
See application file for complete search history.

(56) References Cited

U.S. PATENT DOCUMENTS

| | | | | |
|---|---|---|---|---|
| 6,942,170 | B2 * | 9/2005 | Casalmir et al. | 241/39 |
| 7,850,105 | B2 * | 12/2010 | Ito et al. | 241/39 |
| 2008/0048057 | A1 | 2/2008 | Naka et al. | |
| 2008/0277490 | A1 | 11/2008 | Kinoshita et al. | |

FOREIGN PATENT DOCUMENTS

| | | |
|---|---|---|
| JP | 8-52376 | 2/1996 |
| JP | 8-112543 | 5/1996 |
| JP | 8-187445 | 7/1996 |
| JP | 11-226443 | 8/1999 |
| JP | 2000-5621 | 1/2000 |
| JP | 2004-73992 | 3/2004 |

OTHER PUBLICATIONS

Dec. 3, 2009 European search report in connection with a counterpart European patent application No. 09 17 1152.

* cited by examiner

*Primary Examiner* — Mark Rosenbaum
(74) *Attorney, Agent, or Firm* — Cooper & Dunham LLP

(57) ABSTRACT

A fluid spray nozzle for spraying fluid, satisfying a formula $(r-r0) \leqq L \tan 35°$, wherein r0 is a radius of a section having a minimum area of the nozzle when cut perpendicular to a spray direction of the fluid; and r is a radius of cross-sections of an upstream side and a downstream side of the spray direction from the section having a minimum area with a distance of L.

7 Claims, 5 Drawing Sheets

FLUID SPRAY NOZZLE, PULVERIZER AND METHOD OF PREPARING TONER

BACKGROUND OF THE INVENTION

1. Field of the Invention

The present invention relates to a fluid spray nozzle, a pulverizer and a method of preparing toner.

2. Discussion of the Related Art

Fluidized-bed pulverizers preparing micron order powdery materials are known. The fluidized-bed pulverizer is formed of a plural pulverization nozzles, i.e., fluid spray nozzles, a pulverization chamber and a rotating classifier. In the fluidized-bed pulverizer, the nozzles are located so as to spray a fluid compressed gas toward the center of the pulverization chamber. The powdery materials fed in the pulverization chamber are accelerated toward the center of the pulverization chamber by the compressed gas sprayed from the pulverization nozzles. The powdery materials accelerated toward the center of the pulverization chamber collide against each other at the center thereof to be pulverized. The pulverized powdery materials are fed by an updraft generated at the center of the pulverization chamber to the rotating classifier located above the pulverization chamber. The powdery materials having a particle diameter less than a desired particle diameter are collected by the rotating classifier and returned to the pulverization chamber to be pulverized.

The conventional fluidized-bed pulverizer needs pulverizing repeatedly to prepare particles having a desired particle diameter, resulting in pulverization inefficiency.

Japanese published unexamined application No. 8-52376 discloses a pulverizer increasing the spray speed of a compressed gas from the pulverization nozzles to enhance the pulverization efficiency.

The pulverization nozzles disclosed in Japanese published unexamined application No. 8-52376 has a compressed gas feed nozzle feeding a compressed gas and an acceleration pipe accelerating the compressed gas fed from the compressed gas feed nozzle. The acceleration pipe has an expansion angle θ of some degree. The acceleration pipe having such a shape can well accelerate the compressed gas having passed a throat having the minimum sectional area when the nozzle is cut perpendicular to a traveling direction of the compressed gas to increase the speed of the compressed gas sprayed from the pulverization nozzles. As a result, the powdery material accelerated by the compressed gas sprayed from the pulverization nozzles increases in collision energy and has a desired particle diameter at one time collision pulverization, which increases pulverization efficiency.

As a result of keen studies of the present inventors, they found nozzle conditions having a speed faster than that of the pulverization nozzles disclosed in Japanese published unexamined application No. 8-52376. Namely, as for the pulverization nozzles disclosed therein, the nozzle conditions through which a compressed gas flows to the throat are not studied at all. While the compressed gas flows thereto, the gas loses a pressure and a speed. Consequently, the compressed gas does not have enough speed at the throat and does not, either even when accelerated by the acceleration pipe. Therefore, the compressed gas sprayed from the pulverization nozzles does not have enough speed.

Because of these reasons, a need exists for a fluid spray nozzle capable of spraying a fluid at sufficient speed.

SUMMARY OF THE INVENTION

Accordingly, an object of the present invention is to provide a fluid spray nozzle capable of spraying a fluid at sufficient speed.

Another object of the present invention is to provide a pulverizer using the fluid spray nozzle.

A further object of the present invention is to provide a method of preparing toner using the pulverizer.

To achieve such objects, the present invention contemplates the provision of a fluid spray nozzle for spraying a fluid, satisfying the following formula:

$$(r-r0) \leqq L \tan 35°$$

wherein r0 is a radius of a section having a minimum area of the nozzle when cut perpendicular to a spray direction of the fluid; and r is a radius of cross-sections of an upstream side and a downstream side of the spray direction from the cross-section having a minimum area with a distance of L.

These and other objects, features and advantages of the present invention will become apparent upon consideration of the following description of the preferred of the present invention taken in conjunction with the accompanying drawings.

DESCRIPTION OF THE PREFERRED EMBODIMENTS

Generally, the present invention provides a fluid spray nozzle capable of spraying a fluid at sufficient speed. Particularly, the present invention relates to a fluid spray nozzle for spraying a fluid, satisfying the following formula:

$$(r-r0) \leqq L \tan 35°$$

wherein r0 is a radius of a section having a minimum area of the nozzle when cut perpendicular to a spray direction of the fluid; and r is a radius of cross-sections of an upstream side and a downstream side of the spray direction from the section having a minimum area with a distance of L.

Having a part having the minimum sectional area (throat) and the upstream side of the spray direction of a fluid which satisfy the above-mentioned conditions, the nozzle prevents pressure loss and speed deterioration of the fluid when flowing in the part having the minimum sectional area (throat). In addition, having a part having the minimum sectional area (throat) and the downstream side of the spray direction of a fluid which satisfy the above-mentioned conditions as well, the nozzle well accelerates the fluid from the part having the minimum sectional area (throat) and the downstream side of the spray direction of a fluid. Therefore, the nozzle sprays the fluid at higher speed than before.

Hereinafter, an embodiment of a pulverizer using the fluid spray nozzle of the present invention will be explained.

Figure 1:
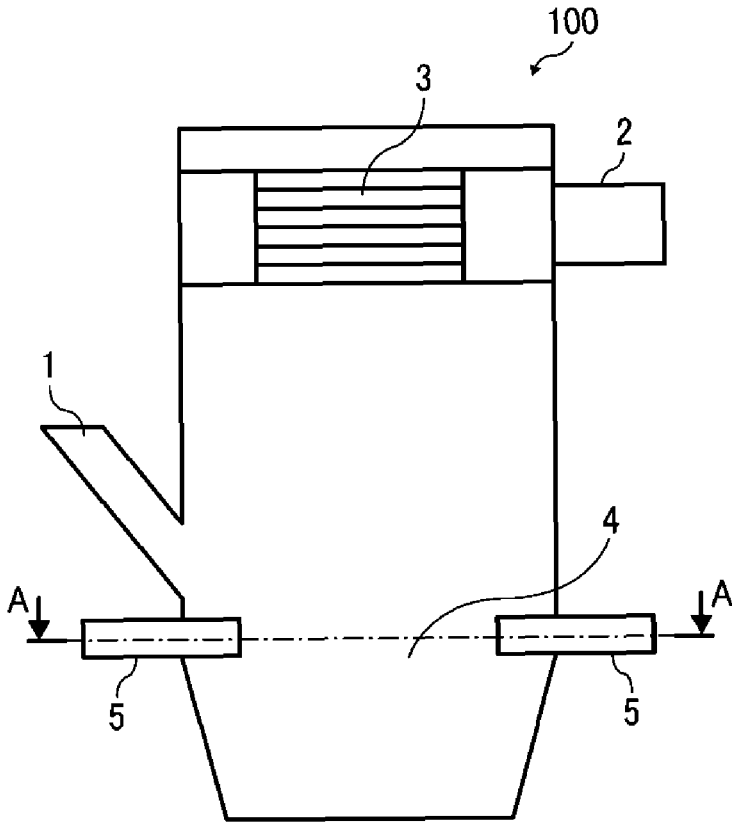
FIG. 1 is a schematic sectional view for explaining an embodiment of the fluidized-bed pulverizer of the present invention.

FIG. 1 is a schematic sectional view for explaining the embodiment of a fluidized-bed pulverizer 100 of the present invention.

Figure 2:
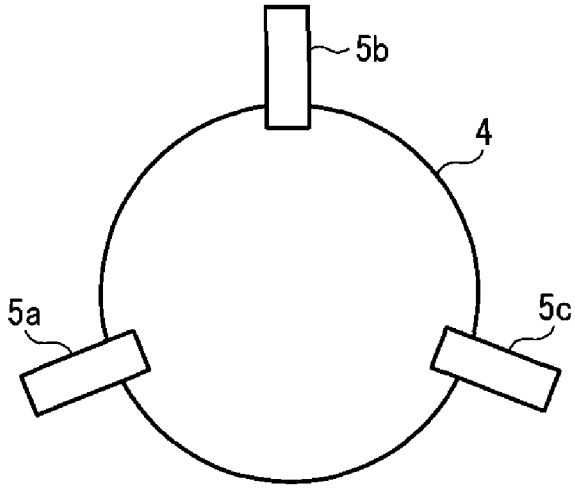
FIG. 2 is a schematic view illustrating an A-A cross-section of the fluidized-bed pulverizer in FIG. 1.

FIG. 2 is a schematic view illustrating an A-A cross-section of the fluidized-bed pulverizer in FIG. 1.

As shown in FIG. 1, the fluidized-bed pulverizer 100 includes 3 pulverization nozzles 5*a* to 5*c*, a pulverization chamber 4 and a rotor 3 which is a rotary classifier.

The pulverization chamber 4 has a feed pipe 1 feeding a powdery material therein on the sidewall. A powdery material feeder (not shown) is connected to the feed pipe 1 and a predetermined amount of the powdery material is fed into the pulverization chamber 4 through the feed pipe 1. As shown in FIG. 2, the nozzle has three nozzle mounting holes equally spaced below the feed pipe 1 of the pulverization chamber 4, and the pulverization nozzles 5*a* to 5*c* are mounted to the nozzle mounting holes so as to have their spray orifices point to the center of the pulverization chamber 4. The rotor 3 which is a rotary classifier is located above the pulverization chamber 4. An exhaust pipe 2 is connected to the rotor 3, and a suction means (not shown) is connected to the exhaust pipe 2.

The shape of the pulverization chamber 4 is not particularly limited, but preferably cylindrical because the powdery material is uniformly fed and pulverized. In addition, the size thereof is not particularly limited, but the chamber preferably has an inner diameter of from 100 to 1,000 mm and a height of from 300 to 3,000 mm, more preferably has an inner diameter of from 300 to 900 mm and a height of from 700 to 2,700 mm, and furthermore preferably has an inner diameter of from 500 to 800 mm and a height of from 1,000 to 2,500 mm because a large amount of the powdery material can efficiently be pulverized.

In the present invention, three pulverization nozzles 5*a* to 5*c* which are fluid spray nozzles are formed, and they may be plural. However, when too many, preparation of the pulverizer is complicated and it is probable that the pulverization efficiency rather deteriorates due to production error, etc. Therefore, the number of the pulverization nozzles are preferably from 2 to 8, more preferably from 2 to 6, and furthermore preferably from 3 to 4. When the number thereof is one, compressed air accompanied with the powdery material cannot first collide each other, resulting in insufficient pulverization effect.

As shown in FIG. 2, the pulverization nozzles 5*a* to 5*c* are preferably formed on a concentric circle centered on a lengthwise central axis of the pulverization chamber 4 such that the compressed air sprayed collides each other on the central axis of the pulverization chamber 4. That the compressed air collides each other on the central axis of the pulverization chamber 4 includes that the compressed air collides each other around the central axis thereof.

The spray orifice of each of the pulverization nozzles 5*a* to 5*c* preferably points upward or downward at an angle not greater than 20°, more preferably not greater than 15°, and furthermore preferably not greater than 10° based on a horizontal direction. When greater than 20°, the pulverization efficiency possibly deteriorates. The details of the pulverization nozzle will be mentioned later.

Figure 3:
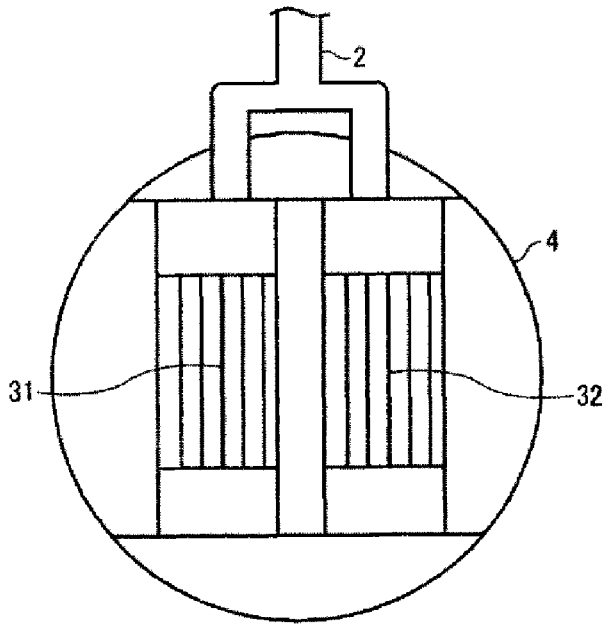
FIG. 3 is a schematic sectional view illustrating an embodiment of the pulverizer including two rotors.

As shown in FIG. 1, the rotor 3 is preferably located at the top of the pulverization chamber 4. When the rotor 3 is located at the top of the pulverization chamber 4, a fine powder and a coarse powder pulverized are directly flown from the pulverization chamber 4 into the rotor 3 to be centrifugally classified. The rotor 3 need not be one, and as shown in FIG. 3, two rotors 31 and 32 may be installed in a horizontal direction such that the centers of the rotors 31 and 32 are connected with the exhaust pipe 2 to collect the powdery material having desired particle diameters from the rotors 31 and 32, respectively.

Next, the pulverization nozzle 5 of this embodiment will specifically be explained.

Figure 4:
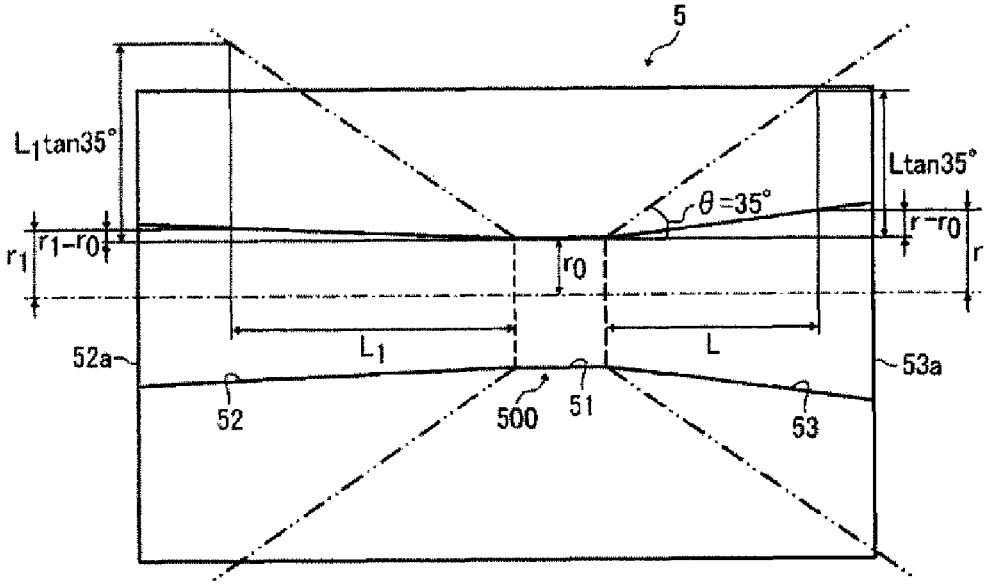
FIG. 4 is a schematic sectional view illustrating an embodiment of the pulverization nozzle of the present invention.
Figure 5:
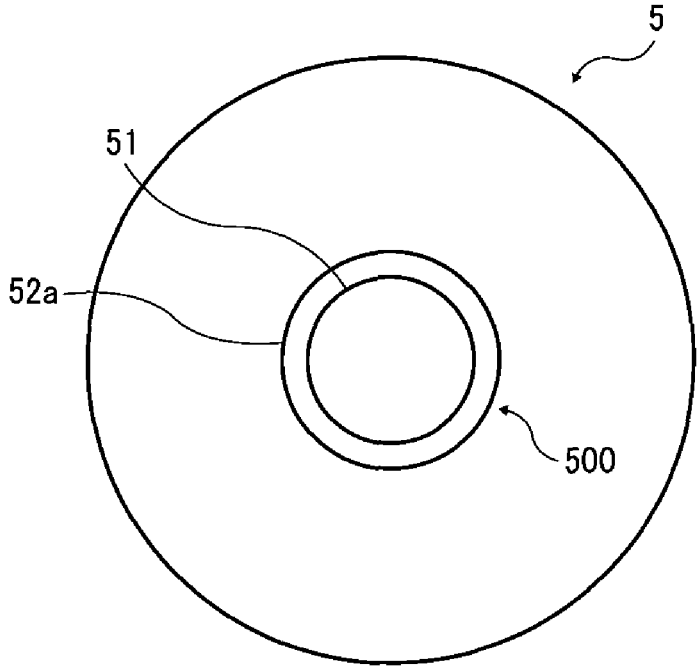
FIG. 5 is a schematic view illustrating the pulverization nozzle seen from a spray orifice.

FIG. 4 is a sectional view of the pulverization nozzle 5. FIG. 5 is a schematic view thereof seen from a spray orifice 52*a*.

As shown in FIG. 5, a flow path pipe 500 including the spray orifice 52*a* spraying fluid compressed air is formed at the center of the pulverization nozzle 5 which is a fluid spray nozzle.

As shown in FIG. 4, the flow path pipe 500 includes a feeding part 53 air compressed by a compressor (not shown) fed in, including an air feeding opening 53*a*; a throat 51 having the minimum sectional area; and an accelerating part 52 accelerating the air compressed at the throat 51 while expanding the air.

The throat 51 has a minimum sectional area, and the feeding part 53 has a larger sectional area toward the air feeding opening 53*a*. Further, the accelerating part 52 has a larger sectional area toward the spray orifice 52*a*. The compressed air fed from the air feeding opening 53*a* is more accelerated toward the throat 51, where the compressed air is accelerated to have a sonic speed. The compressed air accelerated to have a sonic speed is accelerated to have an ultrasonic speed at the accelerating part 52 while expanded, and the compressed air having an ultrasonic speed is sprayed from the spray orifice 52*a*.

As shown in FIG. 4, the feeding part 53 is formed to satisfy a relationship $(r-r0) \leqq L \tan 35°$ when r0 is a radius of the throat 51 and r is a radius at a position apart from the throat 51 of the feeding part 53 by L. In addition, the accelerating part 52 is formed to satisfy a relationship $(r1-r0) \leqq L \tan 35°$ when r1 is a radius at a position apart from the throat 51 of the accelerating part 52 by L.

The feeding part 53 satisfying the above-mentioned relationship does not lower the speed of the compressed air due to pressure loss, etc. while the compressed air flows from the feeding part 53 to the throat 51. Consequently, the compressed air is well accelerated and reliably accelerated to have a sonic speed at the throat 51. Further, the accelerating part 52 satisfying the above-mentioned relationship does not lower the speed of the compressed air accelerated to have a sonic speed at the throat 51 due to pressure loss, etc. therefrom to the spray orifice 52*a*. Consequently, the compressed air is reliably accelerated to have an ultrasonic speed while flown from the throat 51 to the spray orifice 52*a*.

The throat 51 preferably has a radius r0 of from 1.5 to 10 mm. When large, the air volume sprayed from the spray orifice 52*a* increases and a large amount of the compressed air flows in the pulverization chamber 4. In the present invention, a suction means (not shown) suction a gas in the pulverization chamber 4 through an exhaust pipe 2. When the throat 51 has a radius greater than 10 mm, the suction limit is over. Consequently, the amount of the compressed air flowing in the pulverization chamber 4 is larger than the amount thereof suctioned from the pulverization chamber 4 and the inner pressure thereof increases, resulting in not only inability of desired classification by the rotary classifier but also damages thereof. When the throat 51 has a radius less than 1.5 mm, the air volume sprayed from the spray orifice 52*a* decreases, resulting in not only smaller amount of the powdery material pulverized per unit time but also deterioration of pulverization efficiency because of reduction of collision probability among the powdery materials.

A distance between the air feeding opening 53*a* and the throat 51 is preferably from 10 to 100 mm. When less than 10 mm, the compressed air fed from the air feeding opening 53*a* cannot fully be accelerated. When longer than 100 mm, there is no serious problem, but the nozzle becomes large without merit.

The sectional shape of the flow path pipe 500 is not limited, but is typically circular and may be ellipsoidal.

However, the sectional shape thereof is preferably circular in terms of uniforming the distribution of airflow sprayed from the flow path pipe 500 from the center thereof and easy forming.

Figure 6:
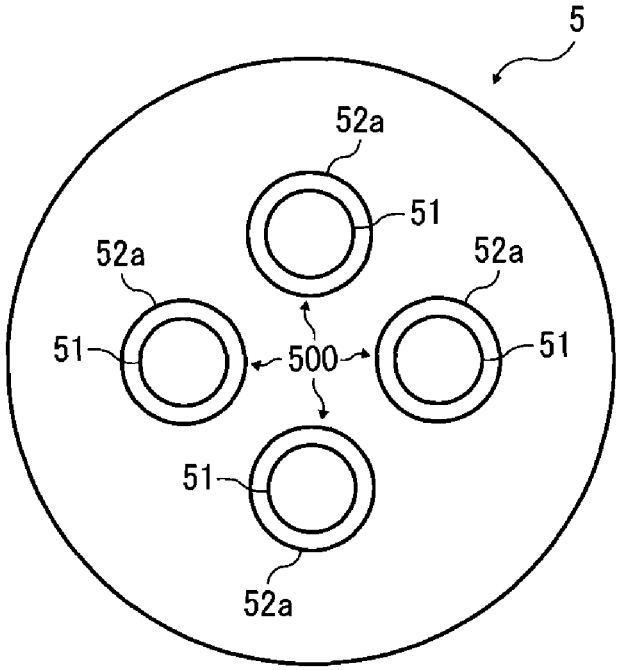
FIG. 6 is a schematic view illustrating the pulverization nozzle including four channel pipes seen from a spray orifice.

As shown in FIG. 6, the flow path pipe 500 may be plural. The pulverization nozzle 5 is preferably formed of 1 to 6, more preferably from 1 to 5, and furthermore preferably from 1 to 4 flow path pipes 500. When too many, it is probable that the pulverization efficiency rather deteriorates because high-speed airflows interfere with each other.

The compressed air fed to the pulverization nozzle 5 preferably has an original pressure of from 0.2 to 1.0 MPa. When less than 0.2 MPa, it is probable that the powdery material cannot be pulverized by collision because the pressure of the compressed air is too low. When greater than 1.0 MPa, the powdery material is occasionally so pulverized that a ratio of the powdery material having diameters smaller than desired increases and a shock wave generated in the pulverization nozzle occasionally causes speed loss.

Figure 7:
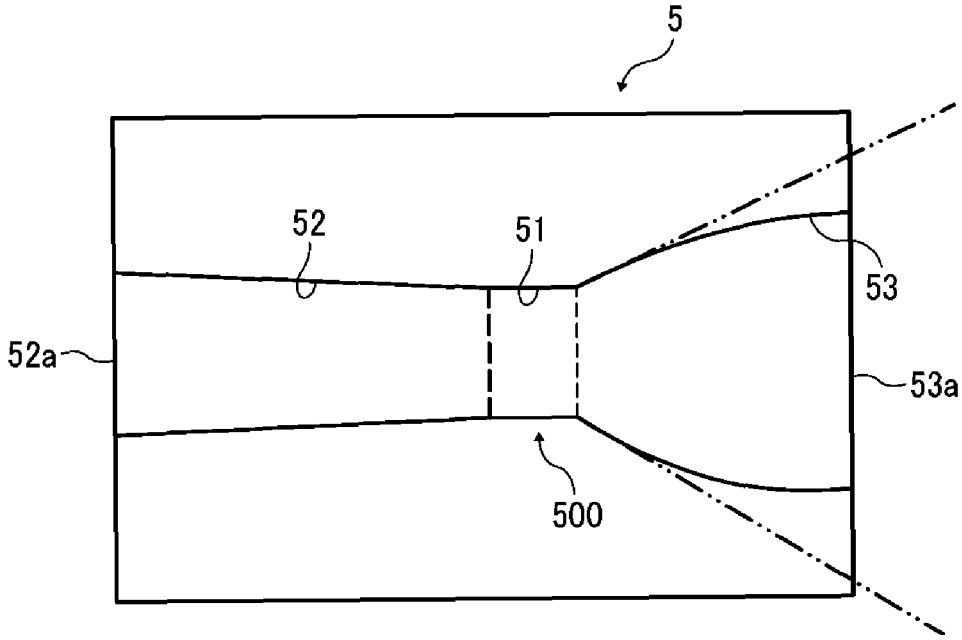
FIG. 7 is a schematic sectional view illustrating another embodiment of the pulverization nozzle of the present invention.
Figure 8:
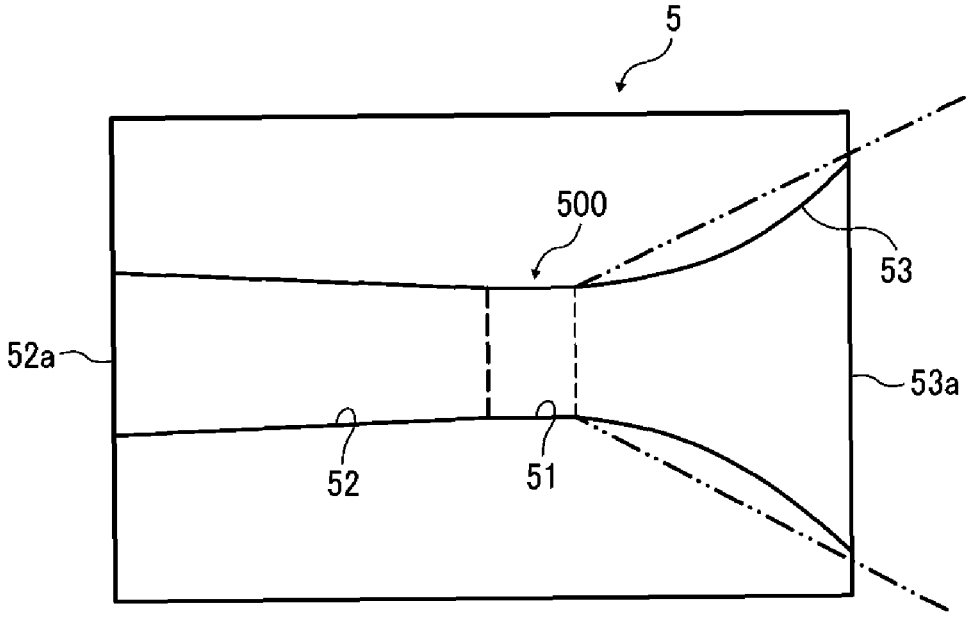
FIG. 8 is a schematic sectional view illustrating a further embodiment of the pulverization nozzle of the present invention.

As mentioned above, the sectional area constantly reduces toward the throat 51, but as shown in FIG. 7, the feeding part 53 may be formed so as to increase the reduction of the sectional area toward the throat 51. Further, as shown in FIG. 8, the feeding part 53 may be formed so as to decrease the reduction of the sectional area toward the throat 51.

Figure 9:
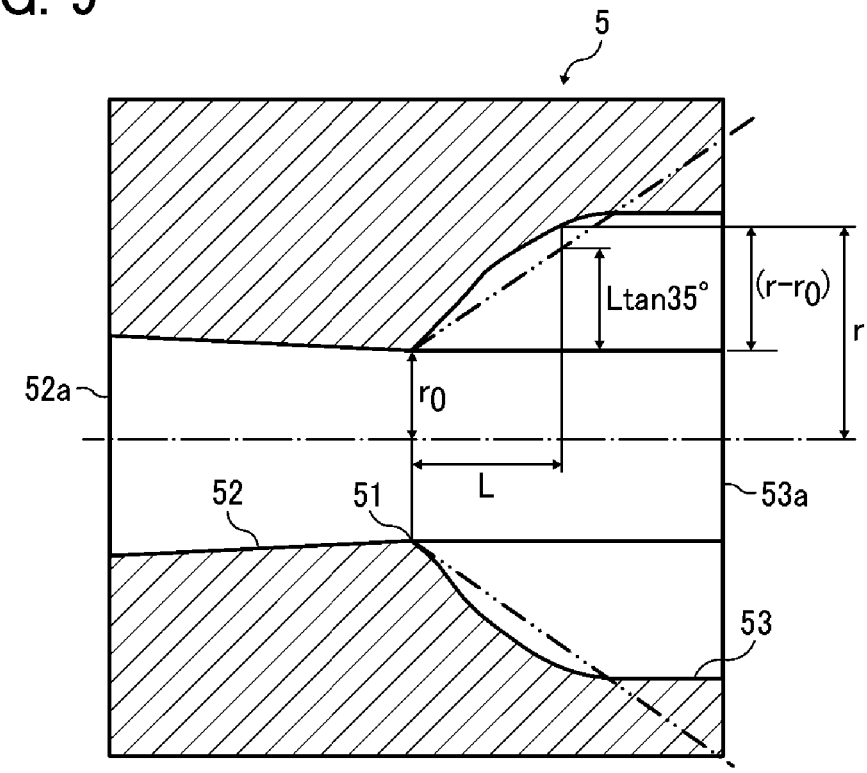
FIG. 9 is a schematic sectional view illustrating a pulverization nozzle not including the configuration of the present invention.

Even when the feeding part 53 is formed so as to increase the reduction of the sectional area toward the throat 51 as shown in FIG. 7, the compressed air deteriorates in speed due to pressure loss while flowing from the feeding part 53 to the throat 51 when (r−r0) at a position apart from the throat 51 by L is over L tan 35° as shown in FIG. 9, resulting in insufficient acceleration of the compressed air. Therefore, the compressed air does not have a sufficient flow speed at the throat 51 and when sprayed from the spray orifice 52*a*. Consequently, the powdery material cannot sufficiently be accelerated, resulting in insufficient pulverization efficiency.

Figure 10:
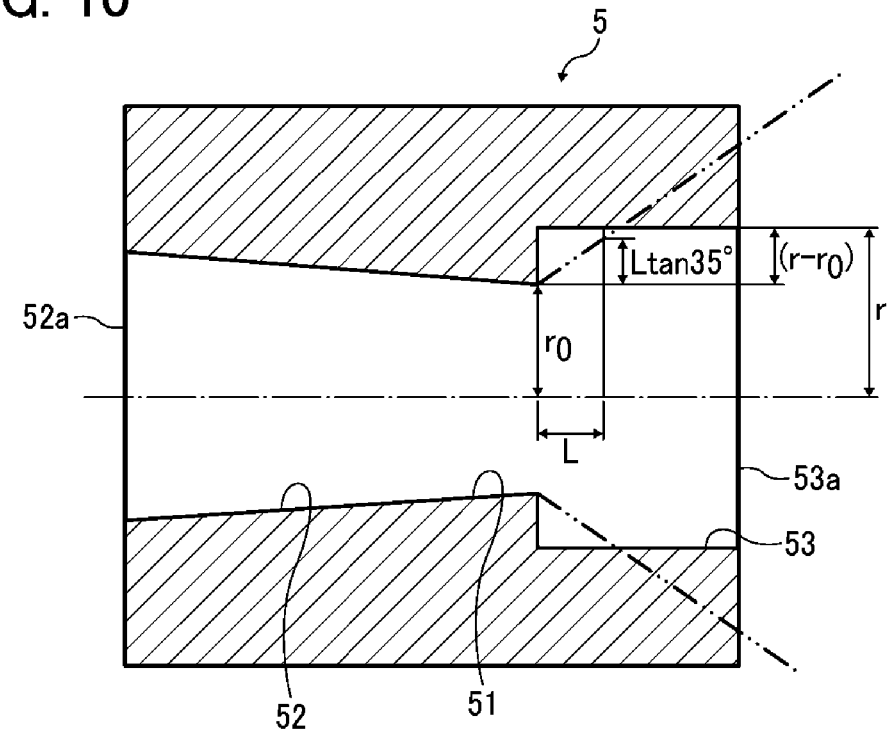
FIG. 10 is a schematic sectional view illustrating a pulverization nozzle used in pulverizer in Comparative Examples 1 and 2.

The present inventors made numerical analyses about pulverization nozzles having the feeding part 53 satisfying relationships of (r−r0)=L tan 40°, (r−r0)=L tan 35° and (r−r0)=L tan 30°, wherein r0 is a radius of the throat 51 and r is a radius at a position apart from the throat 51 by a distance of L; and the pulverization nozzle shown in FIG. 10.

As a result, the pulverization nozzle having the feeding part 53 satisfying the relationship of (r−r0)=L tan 35° has a sprayed air speed faster than that of the pulverization nozzle shown in FIG. 10 by 11%. In addition, the pulverization nozzle having the feeding part 53 satisfying the relationship of (r−r0)=L tan 30° has a sprayed air speed faster than that of the pulverization nozzle shown in FIG. 10 by 13%. The pulverization nozzle having the feeding part 53 satisfying the relationship of (r−r0)=L tan 40° has a sprayed air speed faster than that of the pulverization nozzle shown in FIG. 10 by less than 10%. The present inventors found that the pulverization efficiency improves when the sprayed air speed is faster by not less than 10%, and the relationship of (r−r0)≦L tan 35° increasing the sprayed air speed faster by 10% or more than the conventional speed can improve the pulverization efficiency more than conventional.

Next, the pulverization method of pulverizing the powdery material using the pulverizer 100 will be explained.

First, a predetermined amount of the powdery material is fed into the pulverization chamber 4 through the feed pipe 1 from a powdery material feeder (not shown). Next, compressed air is sprayed from plural pulverization nozzles 5 to accelerate the powdery material fed in the pulverization chamber 4 toward the center thereof such that the powdery material first collides with each other therein to be pulverized. The air therein is suctioned from the exhaust pipe 2 by a suction means (not shown), which causes an updraft. The powdery material which has first collided with each other at the center of the pulverization chamber 4 flows in the rotor 3 rotating at the top thereof. The powdery material flown therein is centrifugally classified thereby, and fine powder of the powdery material is suctioned into the exhaust pipe 2 coaxially located on the rotation axis of the rotor 3 to be exhausted from the pulverization chamber 4. A coarse powder of the powdery material is led to the outside of the rotor 3 by the centrifugal force thereof, and led down below along the wall surface of the pulverization chamber 4 to be pulverized again. The powdery material having an amount equivalent to that thereof exhausted from the exhaust pipe 2 is properly fed to continue pulverization.

The rotor 3 preferably has a rotary circumferential speed of from 20 to 70 m/s. When less than 20 m/s, the classification efficient possibly deteriorates. When faster than 70 m/s, the centrifugal force of the rotor 3 is so large that the powdery material which should be collected by the suction means such as a suction fan is returned again to the pulverization chamber 4 to be pulverized, resulting in excessive pulverization that a ratio of the powdery material having a particle diameter smaller than desired increases.

In the present invention, the flow path pipe 500 of each pulverization nozzle 5 has the shape shown in FIG. 4. Therefore, there is no pressure loss and the compressed air is well accelerated. Consequently, the compressed air sprayed from the pulverization nozzle 5 has sufficient speed and the powdery material led by the sprayed compressed air collides with each other at sufficient energy. The powdery material can efficiently be accelerated and crashed each other, and the pulverization efficiency in the pulverization chamber 4 can be improved.

The pulverizer 100 and the pulverization method in the present invention can improve the pulverization efficiency by simply changing the pulverization nozzle 5 forming the pulverizer 100, and can prepare particles having a particle diameter in a desired scope and a sharp particle diameter distribution with less error at high efficiency.

In addition, the pulverizer 100 and the pulverization method in the present invention can very effectively be used for preparing fine powdery products such as resins, agrichemicals, cosmetics and pigments having particle diameters of microns. Particularly, they are preferably used for preparing the following toner.

(Toner Preparation Method)

A method of producing the toner of the present invention includes at least a pulverization process, a melting and kneading process, a classifying process and other optional processes. The pulverization process is performed using the above-mentioned pulverizer. The other processes include a mixing process applying an external additive mentioned later on the surface of the toner after classified to prepare a final toner.

<Melting and Kneading Process>

The melting and kneading process includes mixing toner materials to prepare a mixture, and melting and kneading the mixture in a kneader. A uniaxial or biaxial continuous kneader and a batch type kneader with a roll mill can be used. Specific examples of the marketed kneaders include TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd), KOKNEADER (from Buss Corporation), etc. It is preferable that the kneading process is performed in proper conditions so as not to cut a molecular chain of the binder resin. Specifically, a temperature of the melting and kneading process is determined in consideration of a softening point of the binder resin. When the temperature is lower than the softening point, the molecular chain of the binder resin is considerably cut. When higher than the softening point, the dispersion does not proceed well.

The toner materials include at least a binder resin, a colorant, a release agent, a charge controlling agent, and other optional components. Each material will specifically be explained.

—Binder Resin—

Specific examples of the binder resin include homopolymers or copolymers of styrenes such as styrene and chlorostyrene; monoolefins such as ethylene, propylene, butylene and isoprene; vinyl esters such as vinylacetate, vinylpropionate, vinylbenzoate and vinylbutyrate; α-methylene aliphatic monocarboxylic acid esters such as methylacrylate, ethylacrylate, butylacrylate, dodecylacrylate, octylacrylate, phenylacrylate, methylmethacrylate, ethylmethacrylate, butylmethacrylate and dodecylmethacrylate; vinylethers such as vinylmethylether, vinylethylether and vinylbutylether; and vinylketones such as vinylmethylketone, vinylhexylketone and vinylisopropenylketone; etc.

Particularly, polystyrene resins, polyester resins, styrene-acrylic copolymers, styrene-acrylic acid alkyl copolymers, styrene-methacrylic acid alkyl copolymers, styrene-acrylonitrile copolymers, styrene-butadiene copolymers, styrene-maleic acid anhydride copolymers, polyethylene resins, polypropylene resins, etc. are typically used. These can be used alone or in combination.

—Colorant—

Specific examples of the colorants for use in the present invention include any known dyes and pigments such as carbon black, Nigrosine dyes, black iron oxide, NAPHTHOL YELLOWS, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials are used alone or in combination.

Specific examples of black pigments include carbon blacks (C.I. Pigment black 7) such as furnace black, lamp black, acetylene black and channel black; metals such as copper, iron (C.I. Pigment Black 11) and titanium oxide; and organic pigments such as aniline black (C.I. Pigment Black 1); etc.

Specific examples of magenta pigments include C.I. Pigment Reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81 83, 87, 88, 89, 90 112, 114, 122, 123, 163, 177, 179, 202, 206, 207, 209 and 211; C.I. Pigment Violets 1, 2, 10, 13, 15, 23, 29 and 35; etc.

Specific examples of cyan pigments include C.I. Pigment Blues 2, 3, 15, 15:1, 15:2, 15:3, 15:4, 15:6, 16, 17 and 60; C.I. Bat Blue 6; C.I. Acid Blue 45; copper phthalocyanine pigment formed of phthalocyanine skeleton, 1 to 5 phthalimidemethyl groups of which are substituted; Greens 7 and 36; etc.

Specific examples of yellow pigments include C.I. Pigment Yellows 1, 2, 3, 4, 5, 6, 7, 10, 11, 12, 13, 14, 15, 16, 17, 23, 55, 65, 73, 74, 83, 97, 110, 151, 154 and 180; C.I. Bat Yellows 1, 3 and 20; and orange 60; etc.

The toner preferably includes the colorant in an amount of from 1 to 15% by weight, and more preferably from 3 to 10% by weight. When less than 1% by weight, toner deteriorates in colorability. When greater than 15% by weight, the colorant is not dispersed well in a toner, resulting in deterioration of colorability and electrical properties of the toner.

The colorant may be used as a masterbatch pigment combined with a resin. Specific examples of the resin include, but are not limited to, styrene polymers or substituted styrene polymers, styrene copolymers, a polymethyl methacrylate resin, a polybutylmethacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, an acrylic resin, rosin, modified rosins, a terpene resin, an aliphatic or an alicyclic hydrocarbon resin, an aromatic petroleum resin, chlorinated paraffin, paraffin waxes, etc. These resins are used alone or in combination.

Specific examples of the styrene polymers or substituted styrene polymers include polyester resins, polystyrene resins, poly-p-chlorostyrene resins and polyvinyltoluene resins. Specific examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butylacrylate copolymers, styrene-octylacrylate copolymers, styrene-methyl methacrylate copolymers, styrene-ethyl methacrylate copolymers, styrene-butyl methacrylate copolymers, styrene-α-chloro methyl methacrylate copolymers, styrene-acrylonitrile copolymers, styrene-vinyl methyl ketone copolymers, styrene-butadiene copolymers, styrene-isoprene copolymers, styrene-acrylonitrile indene copolymers, styrene-maleate copolymers, styrene maleic acid ester copolymers, etc.

The masterbatch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three-roll mill is preferably used for kneading the mixture upon application of high shear stress.

—Release Agent—

The release agent is not particularly limited, and known release agents can be used. Specific examples thereof include waxes including a carbonyl group, polyolefin waxes, long chain hydrocarbons, etc. These can be used alone or in combination.

Specific examples of the waxes including a carbonyl group include ester polyalkanates such as a carnauba wax, a montan wax, trimethylolpropanetribehenate, pentaerythritoltetrabehenate, pentaerythritoldiacetatedibehenate, glycerinetribehenate, and 1,18-octadecanedioldistearate; polyalkanolesters such as tristearyltrimelliticate and distearylmaleate; amide polyalkanates such as ethylenediaminedibehenylamide; polyalkylamides such as tristearylamidetrimelliticate; and dialkylketones such as distearylketone. Among these waxes including a carbonyl group, the ester polyalkanates are preferably used.

Specific examples of the polyolefin waxes include polyethylene waxes and polypropylene waxes.

Specific examples of the long chain hydrocarbons include paraffin waxes and sasol waxes.

The toner of the present invention preferably includes the release agent in an amount of from 0 to 40%, and more preferably from 3 to 30% by weight. When greater than 40% by weight, the resultant toner occasionally deteriorates in fluidity.

—Charge Controlling Agent—

The charge controlling agents is not particularly limited, and known charge controlling agents can be used. However, colorless or whity agents are preferably used because colored agents occasionally charge the color tone of the resultant toner. Specific examples thereof include triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and its derivatives, etc. These can be used alone or in combination.

Specific examples of the marketed products of the charge controlling agents include BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The charge controlling agent may be melted and kneaded with the masterbatch, and dissolved or dispersed, dissolved or dispersed in an organic solvent with other toner materials, or fixed on the surface of a toner after prepared.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

—Other Components—

The other components are not particularly limited, and known materials such as external additives, fluidity improvers, cleanability improvers, magnetic material and metallic soaps can be used.

Specific examples of the external additives include Specific examples of the external additives include particulate silica, hydrophobized particulate silica, fatty acid metallic salts such as zinc stearate and aluminium stearate; metal oxides or hydrophobized metal oxides such as particulate titania, alumina, tin oxide and antimony oxide; fluoropolymers, etc. Among these external additives, the hydrophobized particulate silica, particulate titania and hydrophobized particulate titania are preferably used.

<Pulverization Process>

The melted and kneaded toner materials in the melting and kneading process is cooled and crushed with a hammer mill to prepare coarse powder, and the coarse powder further pulverized with the pulverizer 100 of the present invention.

<Classification Process>

The rotor 3 of the pulverizer 100 collects pulverized materials having a diameter less than desired and a toner collected thereby includes a toner having too small a particle diameter. Therefore, the classification process is for removing the toner having too small a particle diameter. The classification process performs a coarse powder classification and fine powder classification with at least a classifier and a cyclone. The classifier for use in the classification process is not particularly limited, and e.g., airflow classifiers, mechanical classifiers, etc. can be used.

Specific examples of the airflow classifiers include DS classifier from Nippon Pneumatic Mfg. Co., Ltd., Elbow Jet Classifier from Nittetsu Mining Co., Ltd., etc.

Specific examples of the mechanical classifiers include TSP classifier from Hosokawa Micron, Ltd., Turbo Classifier from Nisshin Engineering, Inc.

(Toner)

The toner prepared by the above-mentioned method preferably includes a fine powder having a particle diameter not greater than 4.0 μm in an amount not greater than 15% by number, and more preferably from 0 to 10% by number. In addition, the toner preferably includes a coarse powder having a particle diameter not less than 12.7 μm in an amount not greater than 5.0% by number, and more preferably from 0 to 2.0% by number. Further, the toner preferably has a volume-average particle diameter of from 5.0 to 12.0 μm. The particle diameter distribution and volume-average particle diameter are measured by particle diameter measurers, e.g., Coulter Counter TA-II, Coulter Multisizer II or Coulter Multisizer III from Beckman Coulter, Inc.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The pulverizer having a height of 1,000 mm and including a pulverization chamber having an inner diameter about 600 mm shown in FIG. 1 was used. The pulverizer has equally-spaced (angles) three pulverization nozzles 5 along the wall of the pulverization chamber 4 such that the spray orifice 52*a* points at an angle of 0° based on a horizontal direction. The pulverization nozzle 5 has configurations shown in FIGS. 4 and 5, in which the throat 51 has a radius r0 of 6.5 mm, the air feeding opening 53*a* has a radius about 10 mm and the spray orifice 52*a* has a radius about 8.3 mm. A distance between the throat 51 and the spray orifice 52*a* is about 45 mm, and a distance between the throat 51 and the air feeding opening 53*a* is about 30 mm.

In the pulverization, the compressed air fed to the pulverization nozzle 5 has an original pressure of 0.55 MPa and the rotor 3 has a rotary circumferential speed of 45 m/s.

Example 2

The pulverizer has the same configuration as that of Example 1 except for the shape of the pulverization nozzle 5. The flow path pipe 500 thereof has a shape similar to FIG. 4, and the throat 51 has a radius of 5.6 mm, the air feeding opening 53*a* has a radius about 9 mm and the spray orifice 52*a* has a radius about 7.5 mm. A distance between the throat 51 and the spray orifice 52*a* is about 45 mm, and a distance between the throat 51 and the air feeding opening 53*a* is about 30 mm. The pulverization nozzle 5 has four flow path pipes 500 as shown in FIG. 6.

The compressed air fed to the pulverization nozzle 5 has an original pressure of 0.55 MPa and the rotor 3 has a rotary circumferential speed of 45 m/s.

Comparative Example 1

The pulverizer has the same configuration as that of Example 1 except for the shape of the flow path pipe 500 of the pulverization nozzle 5. The flow path pipe 500 has the shape of FIG. 10. Namely, the feeding part 53 has a fixed sectional area and (r−r0) at the throat 51 is larger than L tan 35°. The accelerating part 52 has a shape similar to Example 1. The throat 51 has a radius r0 of 6.5 mm, the air feeding opening 83*a* has a radius about 10 mm and the spray orifice 52*a* has a radius about 8.3 mm. A distance between the throat 51 and the spray orifice 52*a* is about 25 mm, and a distance between the throat 51 and the air feeding opening 53*a* is about 30 mm. The compressed air fed to the pulverization nozzle 5 has an original pressure of 0.60 MPa and the rotor 3 has a rotary circumferential speed of 45 m/s.

Comparative Example 2

The pulverizer has the same configuration as that of Comparative Example 1 except that the compressed air fed to the pulverization nozzle 5 has an original pressure of 0.55 MPa.

85 parts of styrene-acrylic copolymer resin and 15 parts of carbon black were melted, kneaded, cooled and crushed with a hammer mill to prepare a coarse powder. The coarse powder was further pulverized by the pulverizers of Examples 1 and 2 and Comparative Examples 1 and 2. The results are shown in Table 1. The volume-average particle diameter and distribution thereof were measured as follows.

<Measurement of Volume-Average Particle Diameter and Distribution Thereof>

The particle diameter distribution and volume-average particle diameter were measured by particle diameter measurers, e.g., Coulter Counter TA-II, Coulter Multisizer II or Coulter Multisizer III from Beckman Coulter, Inc. as follows:

0.1 to 5 ml of a detergent, preferably alkylbenzene sulfonate is included as a dispersant in 100 to 150 ml of the electrolyte ISOTON-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

TABLE 1

| | Pulverization pressure (MPa) | Volume-average particle diameter (μm) | Content of fine powder not greater than 4 μm (% by number) | Content of coarse powder not less than 16 μm (% by number) | Pulverization quantity (Kg/hr) |
|---|---|---|---|---|---|
| Example 1 | 0.55 | 6.4 | 64.3 | 0.0 | 58 |
| Example 2 | 0.55 | 6.4 | 61.5 | 0.0 | 62 |
| Comparative Example 1 | 0.60 | 6.4 | 65.1 | 0.0 | 58 |
| Comparative Example 2 | 0.55 | 6.4 | 63.2 | 0 | 47 |

As shown in Table 1, the pulverized powders collected from the pulverizers of Examples 1 and 2 and Comparative Examples 1 and 2 do not have much difference in properties such as volume-average particle diameter, content of fine powder not greater than 4 μm and Content of coarse powder not less than 16 μm. However, Comparative Example 2 noticeably deteriorates in pulverization quantity compared with Examples 1 and 2. Meanwhile, Comparative Example 1 having a pulverization pressure higher than Comparative Example 2 by 0.05 MPa has pulverization quantity equivalent to Examples 1 and 2. In Comparative Example 1, the feeding part 53 has a shape similar to FIG. 10 and (r−r0) at the throat 51 is larger than L tan 35°. Therefore, the compressed air loses a pressure while flowing from the feeding part 53 to the throat 51 and loses a speed, and the compressed air is thought not to be sufficiently accelerated at the throat 51. Then, the compressed air sprayed from the spray orifice 52*a* does not have a sufficient speed and the powdery material is not sufficiently accelerated, resulting in insufficient collision energy and the pulverization quantity less than Examples 1 and 2. When the feeding part 53 has a shape similar to FIG. 10, the compressed air sprayed from the spray orifice 52*a* does not have sufficient speed and does not have the same pulverization quantity as that of Example 1 unless the pulverization pressure is higher than Examples 1 and 2 by 0.05 MPa.

In Examples 1 and 2, since the feeding part 53 has a shape satisfying (r−r0)≦L tan 35°, the compressed air does not lose a pressure while flowing from the feeding part 53 to the throat 51 and does not lose a speed. The compressed air can sufficiently be accelerated at the throat 51. The spray orifice 52*a* can spray the compressed air at sufficient speed even at a pulverization pressure lower than that of Comparative Example 1, can sufficiently accelerate the powdery material and can give sufficient collision energy. This can realize high pulverization efficiency even at a pulverization pressure lower than that of Comparative Example 1.

Example 2 has a larger pulverization quantity than Example 1. The pulverization nozzle 5 has plural flow path pipes and can accelerate and crash the powdery material each other more than Example 1. Therefore, the pulverization efficiency improves and the pulverization quantity is larger than that of Example 1.

As apparent from Examples 1 and 2 and Comparative Examples 1 and 2, when the feeding part 53 has a shape satisfying (r−r0)≦L tan 35°, the pulverization efficiency can be improved because an energy for pulverizing can more effectively be derived from a same energy of the compressed air.

As shown in FIG. 4, the pulverization nozzle satisfies the following formula:

$$(r-r0) \leqq L \tan 35°$$

wherein r0 is a radius of a section having a minimum area of the nozzle when cut perpendicular to a moving direction of a gas; and r is a radius of cross-sections of an upstream side of the moving direction from the section having a minimum area with a distance of L.

This configuration prevents speed reduction of the compressed air due to pressure loss while flowing from the feeding part 53 to the throat 51. The compressed air sufficiently accelerated is flown in the accelerating part to sufficiently accelerate the compressed air sprayed from the spray orifice.

In addition, as shown in FIG. 4, the pulverization nozzle satisfies the following formula:

$$(r1-r0) \leqq L1 \tan 35°$$

wherein r0 is a radius of a section having a minimum area of the nozzle when cut perpendicular to a moving direction of a gas; and r is a radius of cross-sections of a downstream side of the moving direction from the section having a minimum area with a distance of L1.

This configuration prevents speed reduction of the compressed air due to pressure loss while flowing from the feeding part 53 to the throat 51. The compressed air sufficiently accelerated is flown in the accelerating part to sufficiently accelerate the compressed air sprayed from the spray orifice.

A pulverizer can improve its pulverization efficiency when using the pulverization nozzle shown in FIG. 4.

8 or less pulverization nozzles prevents deterioration of the pulverization efficiency due to production error.

The pulverizer can efficiently pulverize a powdery material to have a desired particle diameter.

Further, the pulverizer can efficiently pulverize a toner to have a desired particle diameter.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2008-245558 and 2008-275934, filed on Sep. 25, 2008, and Oct. 27, 2008, respectively, the entire contents of which are herein incorporated by reference.

What is claimed is:

1. A fluid spray nozzle for spraying fluid, satisfying the following formula:

$$(r-r0) < L \times \tan 35°$$

wherein r0 is a radius of a section having a minimum area of the nozzle when cut perpendicular to a spray direction of the fluid; and r is a radius of cross-sections of an upstream side and a downstream side of the spray direction from the section having a minimum a with a distance of L.

2. The fluid spray nozzle of claim 1, wherein the fluid is a gas.

3. A pulverizer, comprising plural gas spray nozzles configured to crash the gas each other with a material to be pulverized, wherein each of the plural gas spray nozzles is the fluid spray nozzle according to claim 1.

4. The pulverizer of claim 3, further comprising a classifier configured to classify the pulverized material.

5. The fluid spray nozzle as claimed in claim 1, wherein the radius of the section having the minimum area is in a range of 1.5 to 10 mm.

6. The fluid spray nozzle as claimed in claim 1, wherein the fluid spray nozzle includes an air feeding opening into which compressed air is fed, and a distance between the section having the minimum area and the air feeding opening is in a range of 10 to 100 mm.

7. The fluid spray nozzle as claimed in claim 1, wherein the fluid spray nozzle includes an air feeding opening into which compressed air is fed, the compressed air having an original pressure in a range of 0.2 to 1.0 MPa.

* * * * *